US007969029B2

(12) United States Patent
Vitagliano

(10) Patent No.: US 7,969,029 B2
(45) Date of Patent: Jun. 28, 2011

(54) DYNAMIC PRESSURE DIFFERENTIAL HYDROELECTRIC GENERATOR

(76) Inventor: Santiago Vitagliano, Miami Beach, FL (US)

( * ) Notice: Subject to any disclaimer, the term of this patent is extended or adjusted under 35 U.S.C. 154(b) by 215 days.

(21) Appl. No.: 12/476,080

(22) Filed: Jun. 1, 2009

(65) Prior Publication Data

US 2010/0301611 A1 Dec. 2, 2010

(51) Int. Cl.
*F02B 63/04* (2006.01)

(52) U.S. Cl. ..... 290/1 R

(58) Field of Classification Search ..... 290/43, 290/44, 54, 55, 1 R; 60/698, 325; 415/7; 416/84, 85; 417/330–333
See application file for complete search history.

(56) References Cited

U.S. PATENT DOCUMENTS

| | | | | |
|---|---|---|---|---|
| 4,041,710 | A * | 8/1977 | Kraus et al. | 60/673 |
| 4,274,009 | A | 6/1981 | Parker | |
| 4,363,212 | A * | 12/1982 | Everett | 60/496 |
| 4,407,130 | A * | 10/1983 | Jackson | 60/496 |
| 4,430,858 | A * | 2/1984 | Shaw | 60/398 |
| 4,498,294 | A * | 2/1985 | Everett | 60/496 |
| 6,291,904 | B1 * | 9/2001 | Carroll | 290/53 |
| 6,313,545 | B1 | 11/2001 | Finley | |
| 6,531,788 | B2 | 3/2003 | Robson | |
| 6,768,216 | B1 * | 7/2004 | Carroll et al. | 290/42 |
| 6,933,624 | B2 | 8/2005 | Beaston | |
| 6,981,376 | B2 | 1/2006 | Dulta | |
| 6,995,479 | B2 | 2/2006 | Tharp | |
| 7,002,261 | B2 | 2/2006 | Cousins | |
| 7,084,521 | B1 | 8/2006 | Martin | |
| 7,091,628 | B1 | 8/2006 | Balt | |
| 7,132,759 | B2 | 11/2006 | Alstot | |
| 7,157,802 | B2 | 1/2007 | Bodkin | |
| 7,218,009 | B2 | 5/2007 | Hendrickson | |
| 7,224,080 | B2 | 5/2007 | Smedstat | |
| 7,239,037 | B2 | 7/2007 | Alstot | |
| 7,291,936 | B1 | 11/2007 | Robson | |
| 7,329,962 | B2 * | 2/2008 | Alstot et al. | 290/54 |
| 7,365,445 | B2 | 4/2008 | Burcik | |
| 7,584,610 | B2 * | 9/2009 | Ziegenfuss | 60/398 |
| 2003/0164613 | A1 | 9/2003 | Finley | |
| 2003/0214135 | A1 | 11/2003 | Peloquin | |
| 2004/0108730 | A1 | 6/2004 | Walsh | |
| 2005/0127681 | A1 | 6/2005 | Shaochun | |
| 2005/0285407 | A1 | 12/2005 | Davis | |
| 2007/0284883 | A1 | 12/2007 | Cafariello | |
| 2008/0191486 | A1 | 8/2008 | Sugano | |
| 2010/0225117 | A1 * | 9/2010 | DeAngeles | 290/54 |

* cited by examiner

*Primary Examiner* — Tho D Ta
(74) *Attorney, Agent, or Firm* — Ruben Alcoba, Esq.

(57) ABSTRACT

A hydroelectric generator that provides a clean source of energy. The hydroelectric generator uses pressurized air as a driving force. The hydroelectric generator comprises of a pipe like housing structure that is anchored to a seabed, the structure is anchored so that water enters through the end of the structure adjacent to the seabed. The structure houses at least one impeller mounted on a shaft and the shaft is operatively connected to an electrical generator. The end of the pipe adjacent to the seabed further comprises of an air injection system., the air injection system has a plurality of openings that release pressurized air within the structure. At least one air compressor connected to at least one air tank. Each air tank is connected, to the air injection system. The air compressor, the air tanks, and the air injection system are all connected by air lines.

18 Claims, 1 Drawing Sheet

DYNAMIC PRESSURE DIFFERENTIAL HYDROELECTRIC GENERATOR

BACKGROUND

Figure 1:
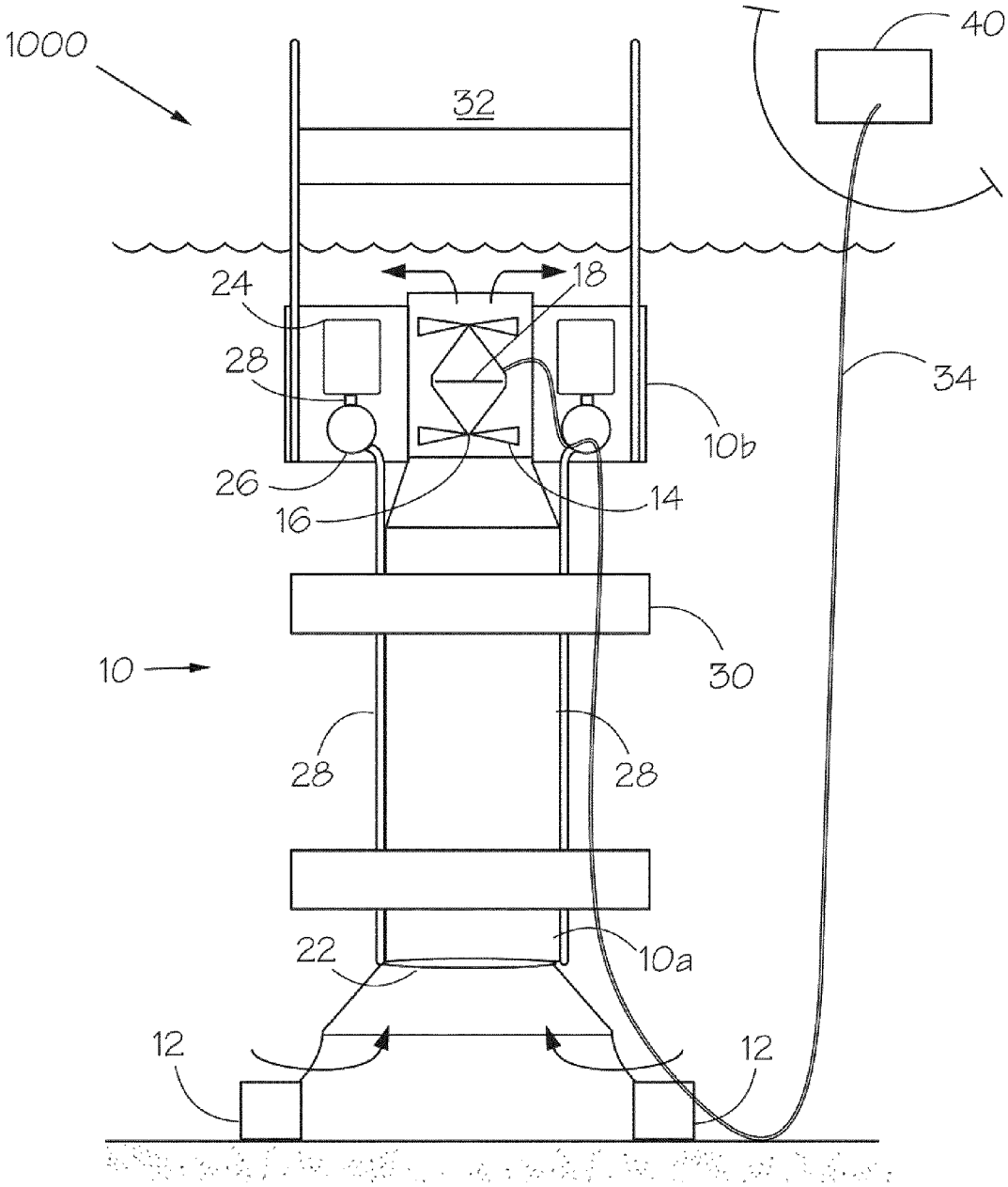

The present invention relates to hydroelectric generators that use the principle that states that a column of air is less dense than a column of water and that in a confined environment, for example in a pipe that runs perpendicular to a seabed, air introduced into tie pipe rises vertically upward from the seabed, thereby creating a lifting force within the tube that in turn creates an upward current of water. The upward current is created when air rises from a higher to a lower pressure zone in the pipe, for when air rises, air expands at a greater rate. The reason for the expansion is that the pressure within the pipe decreases as air rises within the pipe toward the surface. The acceleration of the air within the pipe creates the upward flow of water.

By using the current created within the pipe, the inventor of the present invention has invented a novel way of harnessing the flow of water to produce electrical energy. He harnesses the flow of water by installing within the pipe at least one impeller connected to an electrical generator that transforms mechanical energy into electrical energy. The inventor introduces the compressed air required to create the upward flow of water by using a compressed air delivery system. The compressed air delivery system comprises of at least one air compressor, at least one air tank, and an air injection system. all elements of the air compression system being operatively connected by air lines, and the air injection system attaches to the pipe at the end of the pipe that is adjacent to a seabed in which the pipe is anchored, By creating the upward flow of water by using pressurized air, the inventor has devised a method of producing a clean source of electrical energy, for the air being released into the pipe to create the driving force of the invention will not affect the environment.

For the foregoing reasons, there is a need for a hydroelectric generator that will provide a clean source of energy. The hydroelectric generator shall not be dependent on location. Presently, hydroelectric generators require the generators to be in bodies of water having tidal currents or wherein water is dammed up in order to produce a current. Note, the present invention does not require a specific topographical location to be operational, yet it will require a depth of at least 25 feet to anchor the invention.

SUMMARY

The present invention is directed to a hydroelectric generator that will provide a clean source of energy. The hydroelectric generator uses pressurized air as a driving force.

The hydroelectric generator comprises of a pipe that is anchored to a seabed or to the floor of a body of water, hereinafter seabed shall refer to either a seabed or the floor of a fresh body of water, the pipe is anchored so that water enters through tire end of the pipe adjacent to the seabed. The pipe houses at least one impeller mounted on a shaft, and the shaft is operatively connected to an electrical generator. The end of the pipe adjacent to the seabed further comprises of an air injection system, the air injection system has a plurality of openings that releases pressurized air within the pipe. At least one air compressor operatively connected to at least one air tank. Each air tank is operatively connected to the air injection system. The air compressor, die air tanks, and the air injection system are all operatively connected by air lines.

The present invention might further comprise of at least one buoyancy control unit, each buoyancy control unit attaches to the pipe at various depths. Each buoyancy control unit is used to stabilize the pipe from the rocking motions of the waves of the body of water in which the pipe is anchored, An object of the present invention is to provide a hydroelectric generator that will provide a clean source of energy. The hydroelectric generator shall not he dependent on any typographical location, although it will require that the body of water wherein the hydroelectric generator is installed is at least 25 feet in depth.

Another object of the present invention is to reduce the amounts of hydrocarbons released into the atmosphere when transforming mechanical energy into electrical energy.

A further object of the present invention is to provide a device that transforms mechanical energy into electrical energy safely.

Yet, a further object of the invention is to provide a hydroelectric generator that can be installed in most coastal locations.

Still, a further object of the present invention is to reduce the need of nuclear and coal plants to produce energy.

DRAWINGS

These and other features, aspects, and advantages of the present invention will become better understood with regard to the following description, appended claims, and drawing where;

FIG. 1 is a schematic representation of one embodiment of a hydroelectric generator having features and advantages in accordance with the present invention.

DESCRIPTION

As seen in FIG. 1, a hydroelectric generator 1000 for converting mechanical energy into electrical energy, the hydroelectric generator 1000 uses pressurized air as the driving force, the hydroelectric generator 1000 is displaced within a body of water having a surface and a seabed. A first embodiment of the hydroelectric generator 1000 comprises of a pipe like housing structure 10, the pipe like housing structure 10 has a first 10*a* and second end 10*b*, and the pipe like housing structure 10 might measure in length between 20 to 200 feet. The diameter of the pipe like housing structure 10 will correspond to the length of the pipe like housing structure 10 and in turn the length of the pipe like housing structure 10 will correspond to the output of power required from the hydroelectric generator 1000. The pipe like housing structure's second end 10*b* shall lie below the surface of the body of water in which it is displaced.

The hydroelectric generator 1000 further comprises of at least one anchor 12, each anchor 12 attaches to the first end 10*a* of the pipe like housing structure 10 and further attaches to the seabed. The quantity of anchors 12 required to anchor the pipe like housing structure 10 shall depend on the depth of the body of water in which the pipe like housing structure 10 is displaced and the volume of the pipe like housing structure 10.

The hydroelectric generator further comprises of at least one impeller 14 connected to at least one shaft 16, each shaft 16 removably attaches to the pipe like housing structure 10. The shafts 16 are removably attached, to the pipe like housing structure 10 to allow maintenance of the pipe like housing structure 10. The impellers 14 might be similar to blades found on airplane turbines. The blades will be arranged around the shaft 16 so that they can capture the maximum amount of mechanical energy passed through the blades. The mechanical energy harnessed by the blades will, in turn be transferred to the shaft 16. The mechanical energy is harnessed by passing a pressurized gas-water mixture through the pipe like housing structure 10.

The hydroelectric generator 1000 further comprises of at least one electric generator 18 operatively connected to each shaft 16, each electric generator 18 has a transfer mechanism for transferring electricity to at least one conductor. Each electric generator 18 will have a capacity that is dependant on the output desired from the hydroelectric generator 1000.

The hydroelectric generator 1000 will further comprise of an air injection system 22, the air injection system 22 attaches to the first end 10*a* of the pipe like housing structure 10, the air injection system 22 has a plurality of openings that release pressurized air within the pipe like housing structure 10. The size and shape of the air injection system 22 will be totally dependent on the diameter of the pipe like housing structure 10. The air injection system 22 might be similar to an air injection system found in standard gas grills.

The first embodiment of the hydroelectric generator 1000 will further comprise of at least one air compressor 24 operatively connected to at least one air tank 26. Each air tank 26 is operatively connected to the air injection system 22. Each air compressor 24, each air tanks 26, and the air injection system 22 are all operatively connected by air lines 28 (some of the airlines are not seen in the FIG., for they might be housed within the walls of the pipe like housing structure 10). Each air compressor 24 used will be a standard grade air compressor. The size of each air compressor 24 shall be determined by the quantity of air flow that each air compressor 24 is required to provide on a steady basis to maintain the volume of air passed through the air injection system 22. For example, a compressor providing 20 psi of air pressure might suffice to power the hydroelectric generator having a pipe like housing structure measuring 20 feet in length, while a compressor providing 60 psi of air pressure might suffice to power the hydroelectric generator having a pipe like housing structure measuring up to 100 feet in length. Each air compressor 24 might be housed within the pipe like housing structure or it might be placed outside of the pipe like housing structure.

In another embodiment of the present invention, the hydroelectric generator 1000 might comprise of at least one buoyancy control unit 30, each buoyancy control unit 30 attaches to the pipe like housing structure 10 at various depths. Each buoyancy control unit 30 is used to stabilize the pipe like housing structure 10 from the rocking motions of the waves or currents of the body of water in which the pipe like housing structure 10 is anchored. Each buoyancy control unit 30 shall be attached to the exterior of the pipe like housing structure 10 at predetermined locations to maximize the stabilization of the pipe like housing structure 10. Each buoyancy control unit 30 is calibrated to float at a certain depth of a body of water using means known in the art of buoyancy control.

In a further embodiment of the present invention, the hydroelectric generator shall further comprise of a living quarters 32 that will be attached to the second end 10*b* of the pipe like housing structure 10. The living quarters 32 shall be powered by the hydroelectric generator 1000 and shall serve to house a crew overseeing the hydroelectric generator 1000.

In a further embodiment of the present invention, the hydroelectric generator 1000 shall operatively connect to an inland power grid 40 using at least one underwater cable 34.

The inventor of the present invention has invented a novel method of transforming mechanical energy into electrical energy. The method comprises of providing the above mentioned hydroelectric generator 1000 and displacing the hydroelectric generator 1000 within a body of water having a depth of at least 25 feet. Then securing the hydroelectric generator 1000 to the floor of the body of water so that the second end 10*b* of the pipe like housing structure 10 of the hydroelectric generator 1000 is below the surface of the body of water. Then connecting the hydroelectric generator 1000 to an inland power grid 40 that will receive the electrical energy produced by the hydroelectric generator 1000. Lastly, powering the hydroelectric generator 1000 by pushing compressed air through the injection system 22 of the hydroelectric generator 1000.

An advantage of the present invention is that it provides a hydroelectric generator that provides a clean source of energy. The hydroelectric generator shall not be dependent on any typographical location, although it will require that the body of water wherein the hydroelectric generator is installed is at least 25 feet in depth.

Another advantage of the present invention is that it reduces the amount of hydrocarbons released into the atmosphere when transforming mechanical energy into electrical energy.

A further advantage of the present invention is that it provides a device that transforms mechanical energy into electrical energy safely.

Yet, a further advantage of the present invention is that it provides a hydroelectric generator that can be installed in most coastal locations.

Still, a farmer advantage of the present invention is that it reduces the need of nuclear and coal plants to produce energy.

Although the present invention has been described in considerable detail with reference to certain preferred versions thereof other versions are possible. Therefore the spirit and the scope of the claims should not be limited to the description of the preferred versions contained herein.

What is claimed is:

1. A hydroelectric generator for converting mechanical energy into electrical energy, the hydroelectric generator uses pressurized air as the driving force, the hydroelectric generator is displaced within a body of water having a surface and a seabed, the hydroelectric generator comprises:

a pipe like housing structure, the pipe like housing structure has a first end and a second end opposite to the first end, wherein the pipelike housing structure's second end is below the surface of the body of water in which it is displaced;

at least one anchor, each anchor attaches to the first end of the pipe like housing structure and further attaches to the seabed;

at least one impeller connected to at least one shaft, each shaft removably attaches to the second end of the pipe like housing structure;

at least one electric generator operatively connected to each shaft, each electric generator having a transfer mechanism for transferring electricity to at least one conductor;

an air injection system, the air injection system attaches to the first end of the pipe like housing structure, the air injection system has a plurality of openings that release pressurized air within the pipe like housing structure; and at least one air compressor operatively connected to at least one air tank, each air tank is operatively connected to the air injection system, the air compressor, the air tanks, and the air injection system are all operatively connected by air lines.

2. The hydroelectric generator of claim 1, wherein the pipe like structure measures in length from at least 20 feet to at most 200 feet and the pipe like structure has a diameter that corresponds to the length of the pipe like housing structure, and in turn the length of the pipe like housing structure corresponds to the output of power required from the hydroelectric generator.

3. The hydroelectric generator of claim 2, wherein the quantity of anchors required to anchor the pipe like housing structure depends on the depth of the body of water in which the pipe like housing structure is displaced and the volume of the pipe like housing structure.

4. The hydroelectric generator of claim 3, wherein the impellers will be similar to blades found on airplane turbines, the impellers will be arranged around the shaft of the hydroelectric generator so that they capture the maximum amount of mechanical energy passed through the impellers.

5. The hydroelectric generator of claim 4, wherein each generator will have a capacity that is dependant on the output desired from the hydroelectric generator.

6. The hydroelectric generator of claim 5, wherein the size of and shape of the air injection system will be totally dependent on the diameter of the pipe like housing structure.

7. The hydroelectric generator of claim 6, wherein each air compressor used is a standard grade air compressor, the size of each compressor is determined by the quantity of air flow that each compressor is required to provide on a steady basis to maintain the volume of air passed through the air injection system.

8. The hydroelectric generator of claim 7, further comprises of at least one buoyancy control unit and each buoyancy control unit is attached to the exterior of the pipe like housing structure at predetermined locations.

9. The hydroelectric generator of claim 8, wherein each buoyancy control unit is calibrated to float at a certain depth of the body of water in which the hydroelectric generator is displaced.

10. The hydroelectric generator of claim 9, further comprises living quarters, the living quarters attach to the second end of the pipe like housing structure.

11. The hydroelectric generator of claim 9, further comprises an inland power grid, the inland power grid is operatively connected to the hydroelectric generator via at least one underwater cable.

12. The hydroelectric generator of claim 1, further comprises of at least one buoyancy control unit and each buoyancy control unit is attached to the exterior of the pipe like housing structure at predetermined locations.

13. The hydroelectric generator of claim 12, wherein each buoyancy control unit is calibrated to float at a certain depth of the body of water in which the hydroelectric generator is displaced.

14. The hydroelectric generator of claim 13, further comprises living quarters, the living quarters attach to the second end of the pipe like housing structure.

15. The hydroelectric generator of claim 14, further comprises an inland power grid, the inland power grid is operatively connected to the hydroelectric generator via at least one underwater cable.

16. The hydroelectric generator of claim 1, further comprises living quarters, the living quarters attach to the second end of the pipe like housing structure.

17. The hydroelectric generator of claim 1, further comprises an inland power grid, the inland power grid is operatively connected to the hydroelectric generator via at least one underwater cable.

18. A method of transforming mechanical energy into electrical energy using the hydroelectric generator of claim 1 within a body of water, comprising:

providing the hydroelectric generator;

displacing the hydroelectric generator within the body of water, the body of water having a depth of at least 25 feet;

then, securing the hydroelectric generator to the floor of the body of water so that the second end of the pipe like housing structure of the hydroelectric generator is below the surface of the body of water;

next, connecting the hydroelectric generator to a power grid that will receive the electrical energy produced by the hydroelectric generator; and lastly, powering the hydroelectric generator by pushing compressed air through the injection system of the hydroelectric generator.

* * * * *